US009534529B2

(12) United States Patent
Capelle et al.

(10) Patent No.: US 9,534,529 B2
(45) Date of Patent: Jan. 3, 2017

(54) EXHAUST GAS HEAT EXCHANGER WITH AN OSCILLATION ATTENUATED BUNDLE OF EXCHANGER TUBES

(71) Applicant: VISTEON GLOBAL TECHNOLOGIES, INC., Van Buren Township, MI (US)

(72) Inventors: Andreas Capelle, Pulheim (DE); Guillaume Hebert, Stare Mesto (CZ); Andrej Repa, Dolna Suca (SK)

(73) Assignee: HANON SYSTEMS, Daejeon (KR)

( * ) Notice: Subject to any disclaimer, the term of this patent is extended or adjusted under 35 U.S.C. 154(b) by 652 days.

(21) Appl. No.: 13/759,157

(22) Filed: Feb. 5, 2013

(65) Prior Publication Data

US 2013/0213368 A1 Aug. 22, 2013

Related U.S. Application Data

(62) Division of application No. 12/171,508, filed on Jul. 11, 2008, now Pat. No. 8,387,684.

(30) Foreign Application Priority Data

Jul. 11, 2007 (DE) ..... 102007032188
Jun. 13, 2008 (DE) ..... 102008002430

(51) Int. Cl.

| | |
|---|---|
| ***F28D 7/06*** | (2006.01) |
| ***F02B 29/04*** | (2006.01) |
| ***F28F 1/06*** | (2006.01) |
| ***F28F 1/08*** | (2006.01) |
| ***F28F 9/013*** | (2006.01) |

(Continued)

(52) U.S. Cl.

CPC ..... *F02B 29/0462* (2013.01); *F02M 26/11* (2016.02); *F02M 26/32* (2016.02); *F28D 1/0475* (2013.01); *F28D 7/06* (2013.01); *F28F 1/06* (2013.01); *F28F 1/08* (2013.01); *F28F 9/0132* (2013.01); *F01N 2240/02* (2013.01); *F28F 2009/224* (2013.01); *F28F 2225/04* (2013.01)

(58) Field of Classification Search

CPC ..... F28F 9/0132; F28D 7/06; F28D 7/163
USPC ..... 165/162, 163
See application file for complete search history.

(56) References Cited

U.S. PATENT DOCUMENTS 4,167,211 A * 9/1979 Haller ..... F28F 9/0132 165/162
4,210,202 A * 7/1980 Boyer et al. ..... F28F 9/0135 165/162

(Continued)

FOREIGN PATENT DOCUMENTS

DE 10011954 A1 9/2001
DE 102004019554 A1 11/2005

(Continued)

*Primary Examiner* — Allen Flanigan
(74) *Attorney, Agent, or Firm* — Fraser Clemens Martin & Miller LLC; James D. Miller

(57) ABSTRACT

A heat exchanger is disclosed for the exhaust gas train of a motor vehicle. The heat exchanger includes a bundle of separately formed exhaust gas carrying exchanger tubes that is disposed in a closed housing formed separately, a coolant flowing through the housing and around the outside of the exchanger tubes. A bandage is disposed on the bundle of exchanger tubes mechanically connecting a plurality of the exchanger tubes to militate against an oscillation of the exchanger tubes.

19 Claims, 10 Drawing Sheets

(51) Int. Cl.
*F28D 1/047* (2006.01)
*F28F 9/22* (2006.01)

(56) References Cited

U.S. PATENT DOCUMENTS

| | | | | | |
|---|---|---|---|---|---|
| 4,384,550 | A * | 5/1983 | Miller | F24J 2/07 | 122/510 |
| 4,384,697 | A * | 5/1983 | Ruhe | F28F 9/0135 | 165/162 |
| 5,012,767 | A * | 5/1991 | Sheikh et al. | F22B 37/143 | 122/235.14 |
| 5,136,985 | A * | 8/1992 | Krowech | F28F 9/0132 | 122/510 |
| 2007/0089856 | A1 * | 4/2007 | Wanni et al. | F22B 37/205 | 165/69 |

FOREIGN PATENT DOCUMENTS

| | | | |
|---|---|---|---|
| DE | 102006009948 | A1 | 10/2006 |
| DE | 102005055482 | A1 | 5/2007 |
| DE | 102006049106 | A1 | 6/2007 |

* cited by examiner

EXHAUST GAS HEAT EXCHANGER WITH AN OSCILLATION ATTENUATED BUNDLE OF EXCHANGER TUBES

CROSS-REFERENCE TO RELATED APPLICATION

This application is a divisional application of U.S. patent application Ser. No. 12/171,508 filed Jul. 11, 2008, hereby incorporated herein by reference in its entirety, which claims priority to German Provisional Patent Application Serial No. DE 102007032188.2 filed Jul. 11, 2007 and German Non-Provisional Patent Application Serial No. DE 102008002430.9 filed Jun. 13, 2008, each of which is hereby incorporated herein by reference in its entirety.

FIELD OF THE INVENTION

The present invention relates to a heat exchanger for an exhaust train of a motor vehicle, and more specifically to an exhaust gas recirculation system for an internal combustion engine of a motor vehicle.

BACKGROUND OF THE INVENTION

Due to the ever more stringent legal regulations regarding exhaust emission of motor vehicles, in particular regarding emission of nitrogen oxides, recirculation of combustion exhaust to the inlet side of the internal combustion engine is state of the art in the field of internal combustion engines. The combustion gases themselves do not participate again in the combustion process in the combustion chamber of the internal combustion engine so that they constitute an inert gas that dilutes the mixture of combustion air and fuel in the combustion chamber and ensures more intimate mixing. It is thus possible to minimize the occurrence of what are termed hot spots during the combustion process, the hot spots being characterized by very high local combustion temperatures. Such very high combustion temperatures promote the formation of nitrogen oxides and must therefore be imperatively avoided.

Since the efficiency of an internal combustion engine is typically dependent on the temperature of the combustion air fed into the combustion chamber of the internal combustion engine, the combustion gases cannot be recirculated to the intake side immediately after having left the combustion chamber of the internal combustion engine. Instead, the temperature of the combustion gas must be significantly lowered. Typically, the temperatures of the combustion gases leaving the combustion chamber of the internal combustion engine are of 900° C. and more. The temperature of the combustion air fed to the combustion chamber of the internal combustion engine on the inlet side should, by contrast, not exceed 150° C. and preferably be significantly less than that. For cooling the recirculated combustion gases, it is known in the art to utilize what are termed exhaust recirculation coolers. Various constructions are known in the art in which the combustion gases to be cooled are usually circulated through exchanger tubes around the outer side of which a coolant flows, the coolant usually being the cooling water of the motor vehicle. For efficiency increase, it has been proposed in prior art to lead the combustion gases to be cooled through a bundle of exchanger tubes connected in parallel in terms of fluid flow, the coolant generally flowing around the tubes.

From the document DE 10 2004 019 554 A1 an exhaust gas recirculation system for an internal combustion engine is known which comprises an exhaust gas heat exchanger implemented as a two-part cast part. Since the very hot combustion gases are reactive due to the fact that the fuel never burns completely, the problem here is that it is technically difficult if not impossible to design the surfaces of a metallic cast part as inert surfaces comparable with a stainless steel surface.

From the document DE 10 2005 055 482 A1 an exhaust gas heat exchanger for an internal combustion engine is known that avoids the problems mentioned above by implementing the surfaces coming into touching contact with the hot combustion gases as non-corrosive steel surfaces. The heat exchanger tubes and the housing accommodating the heat exchanger tubes are configured to be separate parts that are assembled during the manufacturing process.

In the exhaust gas heat exchanger known from the document DE 10 2006 009 948 A1, the channels carrying the hot gas and the housing in which the coolant flowing around the exhaust channels flows are configured integrally in the form of a plate heat exchanger. The flow paths for the hot combustion gases as well as the flow paths for the coolant only form when individual, for example deep-drawn plates are being assembled to form a plate heat exchanger. A similar concept is pursued in the document DE 10 2006 049 106 A1.

General information regarding the technique of exhaust gas recirculation in internal combustion engines may be inferred from the document DE 100 119 54 A1 for example.

It would be desirable to produce a heat exchanger for an exhaust train of a motor vehicle that includes a bundle of separately formed exhaust gas carrying exchanger tubes exhibiting an improved Noise, Vibration, Harshness (NVH) behaviour over the prior art constructions.

SUMMARY OF THE INVENTION

Compatible and attuned with the present invention, a heat exchanger for an exhaust train of a motor vehicle that includes a bundle of separately formed exhaust gas carrying exchanger tubes exhibiting an improved Noise, Vibration, Harshness (NVH) behaviour over the prior art constructions, has surprisingly been discovered.

A heat exchanger of the invention is provided for the exhaust train of a motor vehicle. The heat exchanger comprises a bundle of separately formed exhaust carrying exchanger tubes that are connected in parallel in terms of fluid flow. The exchanger tubes are disposed in a separately formed, closed housing through which a coolant flows. The coolant flows around the exchanger tubes outside thereof. In accordance with the invention, there is provided a bandage for the bundle of heat exchanger tubes which is disposed on the bundle outside thereof. The bandage further connects a plurality of heat exchanger tubes together for a solid mechanical connection to militate against a vibration of at least the outer tubes of the bundle.

In a further developed implementation, the bandage further forms a mechanical abutment for the heat exchanger tubes joined together by the bandage with respect to the housing. In this way, the bandage not only prevents relative vibrations of the exchanger tubes of the bundle with respect to each other but also collective vibrations of the bundle in general with respect to the housing surrounding the bundle.

Particular advantages are obtained if the abutment is configured to be resilient so that the bundle of heat exchanger tubes is resiliently supported with respect to the housing of the heat exchanger.

In a particularly preferred embodiment of the heat exchanger of the invention, the bandage is implemented so as to form an at least partial but preferably complete surrounding grip around the bundle of exchanger tubes.

In a further improved implementation of the heat exchanger of the invention, a baffle for guiding the flow of the coolant in the housing is disposed in the housing of the heat exchanger, within the bundle of tubes. Advantages with respect to the NVH behaviour are obtained if this baffle is mechanically connected to a plurality of exchanger tubes, such as by soldering or welding. Typically, the baffle is connected here to the exchanger tubes immediately adjacent the baffle. Advantageously, the baffle is not only connected to a plurality of exchanger tubes but is also mechanically solidly connected to the housing of the heat exchanger, here in particular to a housing portion such as a cover part for example.

The particular, vibration-reduced implementation of the heat exchanger bundle of the invention is of particular advantage if the inlets and the outlets of the exchanger tubes are disposed outside of the heat exchanger housing and if a winding flow path extends in the exchanger tubes within the housing, the flow path including an angle of rotation of at least 135°, preferably however of 180°. In such a u-shaped or semi-circular configuration of the exchanger tubes, the exchanger tubes typically only abut mechanically at the points at which they are connected through the wall of the heat exchanger housing, thus forming a system very well capable of vibrating. This capability of vibration is strongly reduced by the bandage that is provided in accordance with the invention and forms a surrounding grip around the bundle of tubes. It is even further reduced by the baffle already mentioned herein above, which is also connected to a plurality of exchanger tubes.

The vibrating capability of the bundle of exchanger tubes can be further reduced if a stiffening element mechanically solidly connecting a plurality of heat exchanger tubes is disposed inside the bundle. Such a stiffening element can be made from a suitably shaped metal strip for example, which is connected to the exchanger tubes by means of soldering or welding. The metal strip can be equipped with the necessary stiffness by giving the metal strip the appropriate profile, for example a V or a U profile.

Preferably, the exchanger tubes in the heat exchanger of the invention are made from one piece, at least between the points at which they are conducted through the wall of the heat exchanger housing, and are made from a corrosion and heat resistant material such as stainless steel, aluminum or an aluminum alloy. In order to achieve best possible heat transfer from the hot combustion exhaust carried in the exchanger tubes and the coolant flowing around the exchanger tubes outside thereof, the exchanger tubes are equipped with the least possible wall thickness, their vibration capability increasing as a result thereof, though. The thermal efficiency can be further increased if intensive turbulence is ensured in the exhaust gas carried in the exchanger tubes; for this purpose, a spiral structure can be formed on the inner surfaces of the exchanger tubes. In a particularly efficient way, such a spiral structure can be produced by stamping the wall of the respective exchanger tubes; as a result, the stiffness of the exchanger tubes is even further reduced, this causing the vibration capability of the bundle of exchanger tubes to increase even further. In particular in this context, the previously mentioned vibration-reduced measures taken at the bundle of exchanger tubes are advantageous.

BRIEF DESCRIPTION OF THE DRAWINGS

The above, as well as other objects and advantages of the invention, will become readily apparent to those skilled in the art from reading the following detailed description of a preferred embodiment of the invention when considered in the light of the accompanying drawing which:

FIG. 6 is a schematic illustration of an exchanger tube that forms a winding flow path for illustrating the angle of revolution a;

DETAILED DESCRIPTION OF THE INVENTION

The following detailed description and appended drawings describe and illustrate various embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
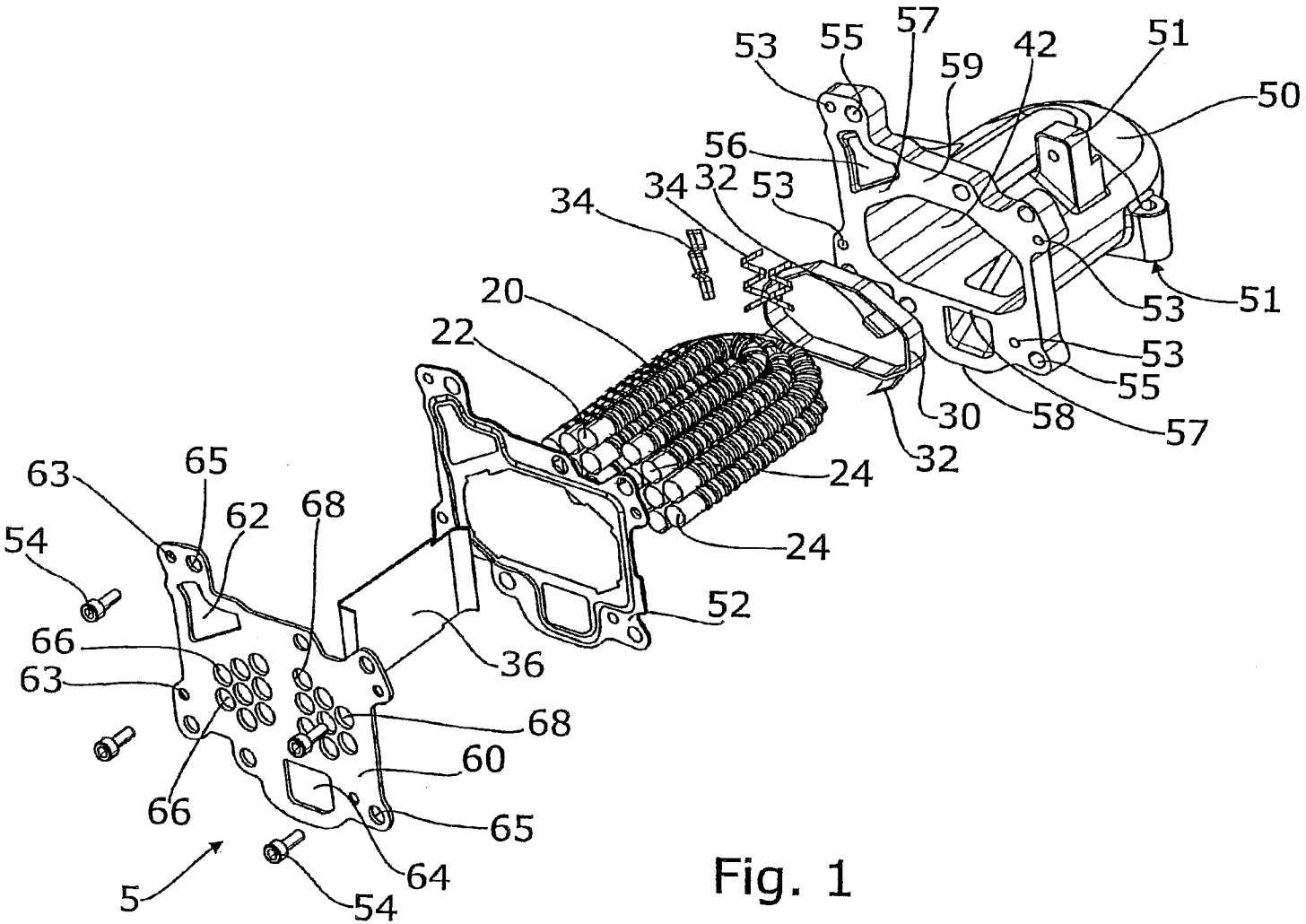
FIG. 1 shows an exploded view of a first exemplary embodiment of an exhaust gas heat exchanger of the invention.

FIG. 1 shows an exploded view of an exhaust gas heat exchanger 1 of the invention according to a first exemplary embodiment. The heat exchanger 1 includes a housing 40 consisting of a housing case 50 closed by means of a housing cover 60. The housing case 50 is configured to be a cast part and may be made from aluminum die casting in particular. Alternatively, the housing case 50 in the exemplary embodiment shown may be made from any material that can be processed by casting on the one side and that has sufficient thermal stability on the other side. Since the housing case 50 of the heat exchanger 1 of the invention only comes into touching contact with the coolant usually originating from the coolant circuit of the motor vehicle, a resistance to temperatures of up to 150° C. is sufficient for most of the cases of application. Magnesium or magnesium alloys, grey cast iron or also heat resistant and die-castable plastic materials have been found to be further materials suited for the housing case.

On the front side, the housing case forms a flange 59 for connection to a housing cover 60. In the exemplary embodiment shown, the housing cover 60 consists of a punched steel plate having a thickness of a few millimeters, preferably of approximately 2 mm. The housing case 50 is connected for liquid and gas tight connection to the housing part 60, a seal 52, which, in the exemplary embodiment shown, is configured to be a metal bead seal, being inserted therein between. The housing cover 60 is thereby screwed to the flange 59 of the housing case 50 by means of screws 54; for this purpose, the housing case 50 forms a plurality of large threaded holes 55. At the corresponding positions, the housing cover 60 comprises through holes 65 of large diameter through which screws 54 of mating dimensions are threaded and inserted into the threaded holes 55 for the housing cover 60 to be screwed to the housing case 50.

The housing case 50 forms an inner volume 42 that is provided for accommodating therein a bundle of generally U-shaped exchanger tubes 20. The exchanger tubes 20 are identical with respect to their dimensions such as inner and outer diameter, but the opening width W of the U-shaped profile varies. The shape of the inner volume 42 and as a result thereof of the housing case 50 is generally adapted to the shape of the bundle of exchanger tubes 20 so that the bundle of exchanger tubes 20 allows for using most efficiently the space in the inner volume 42.

At their respective ends, the exchanger tubes 20 each form an inlet 22 and an outlet 24. The ends of the exchanger tubes 20 are thereby conducted through corresponding holes in the housing cover 60, which form the passage points 66, 68 for the inlets or the outlets of the exchanger tubes 20. The inlets and outlets 22, 24 of the exchanger tubes 20 are thereby conducted through the holes formed in the housing cover 60; at the passage points 66, 68, the exchanger tubes 20 are connected for gas and liquid tight connection to the housing cover 60 such as by soldering or welding. As a result, the exchanger tubes 20 mechanically abut the housing cover 60.

In a preferred embodiment, the exchanger tubes 20 consist of thin-walled stainless steel tubes. The exchanger tubes 20 are thereby provided with a stamped structure so that a raised spiral-shaped structure 26 is formed on the inner surface of the exchanger tubes 20. The bundle of exchanger tubes 20 is thereby disposed so that all the inlets 22 and all the outlets 24 are respectively arranged in one cohesive group for ease of connection of the heat exchanger 1 of the invention to the exhaust gas system of the motor vehicle for example. For this purpose, the front side of the housing cover 60 forms an assembly interface S that is configured in a substantially flange-like fashion due to the planar configuration of the housing cover 60. For mounting the heat exchanger 1 to the motor vehicle, further threaded holes 53 are formed in the housing case 50, the holes having a smaller diameter compared to the threaded holes 55. In the metal bead seal 52 as well as in the housing cover 60 there are formed corresponding through holes 63. Via these holes, the heat exchanger 1 can be connected to the exhaust gas and coolant system of the motor vehicle through a plurality of screws, which have not been illustrated in FIG. 1.

Beside the inner volume 42 accommodating the bundle of exchanger tubes 20, the housing case 50 forms an inlet channel 56 and an outlet channel 58 for a coolant; the coolant can be a cooling liquid from the cooling system of the internal combustion engine of the motor vehicle. The inlet channel 56 and the outlet channel 58 are thereby arranged for a flow path extending from the top to the bottom (in FIG. 1) to form through the inner volume 42 of the housing case 50 when the heat exchanger 1 is operated according to the use it was intended for so that the bundle of exchanger tubes is intensively flooded by the coolant. In order to achieve as intensive as possible an interaction between the coolant and the surface of the exhaust gas carrying exchanger tubes 20, a baffle plate 36 is further disposed within the legs of the U-shaped exchanger tubes 20, the baffle plate being again preferably made from stainless steel in the exemplary embodiment shown and being butt soldered or butt welded to the housing cover 60 also made from stainless steel. The baffle plate 36 lengthens the flow path of the coolant in the inner volume 42 of the housing 40, thus ensuring a more intensive thermal exchange between the exhaust gas flowing in the exchanger tubes 20 and the coolant flowing in the inner volume 42.

The inlet channel 56 as well as the outlet channel 58 formed in the housing case 50 also end in the flange 59 formed by the housing case 50, webs 57 being formed at the ends of the channels 56 and 58 for forming a mechanical abutment for the metal bead seal 52 resting on the flange 59. The seal also forms passageways for the coolant flowing through the heat exchanger 1, which correspond to the coolant inlet 62 and the coolant outlet 64 formed in the housing cover 60. In the assembled heat exchanger 1, coolant can be both supplied through the coolant inlet 62 and evacuated through the coolant outlet 64 and the combustion exhaust gas to be cooled can be supplied through the inlets 22 of the exchanger tubes 20 and evacuated through the outlets 24 via the front side of the housing cover 60. In the construction shown, this is possible through one single common mounting interface S.

Figure 2:
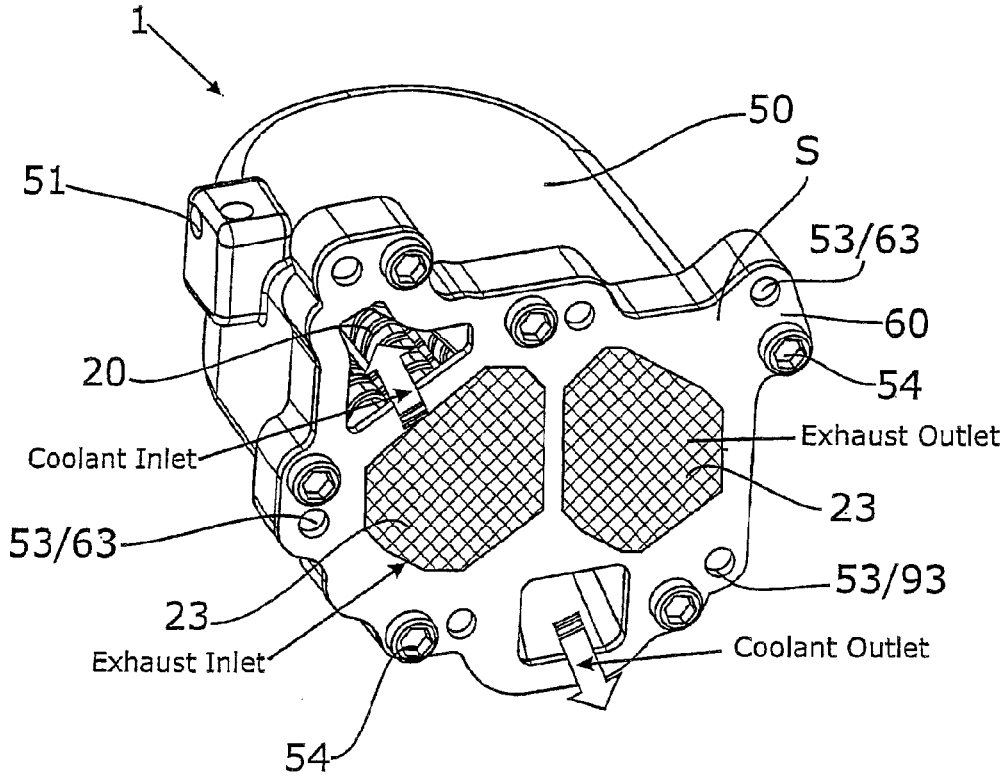
FIG. 2 is a perspective view of a mounting interface S of an exhaust gas heat exchanger according to a second exemplary embodiment.

This is particularly obvious from the illustration shown in FIG. 2 which shows an elevation view of a mounting interface S of the heat exchanger 1 in a slightly altered embodiment. The coolant inlet 62 formed in the housing cover 60 and the coolant outlet 64 are clearly visible. By contrast, the majority of inlets 22 and outlets 24 of the exchanger tubes 20 is covered by grid structures 23 in the illustration shown in FIG. 2. The arrangement of the inlets 22 and of the outlets 24 in the housing cover 60 substantially corresponds to the configuration shown in FIG. 1. For the rest, the heat exchanger shown in the illustration of FIG. 2 substantially differs by the modified arrangement of fastening points 51 to the housing case 50, these fastening points 51 serving to fasten the heat exchanger 1 to mounting structures of the motor vehicle.

Figure 3:
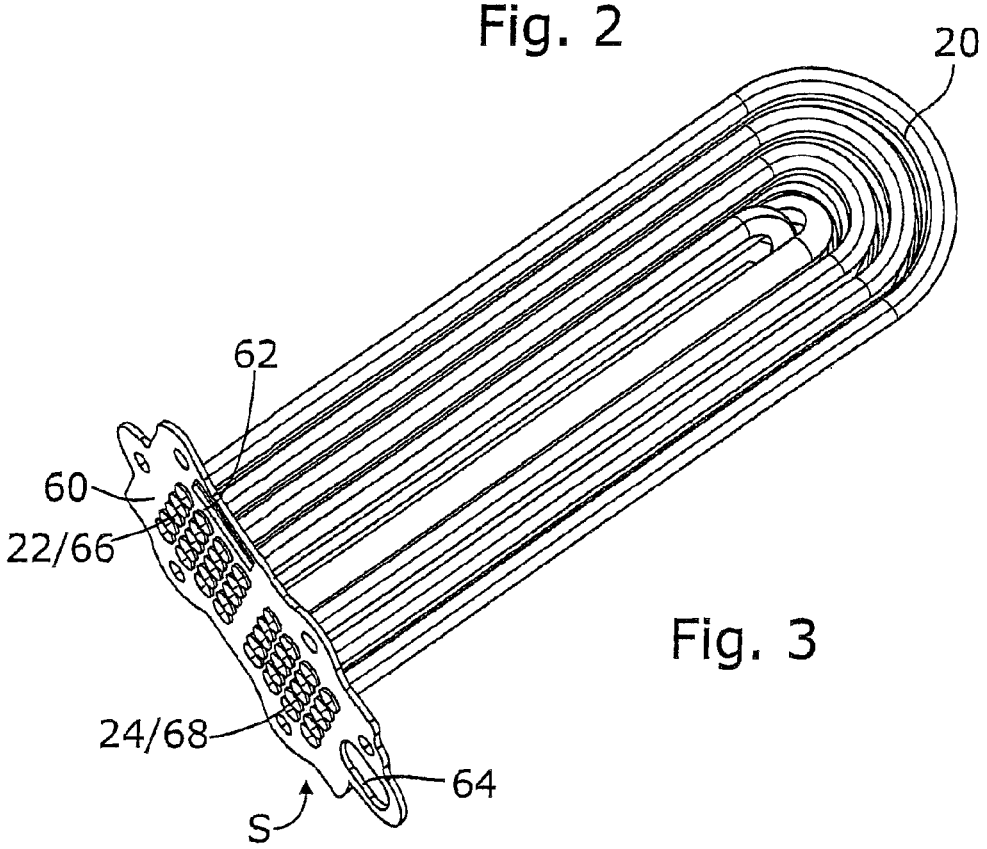
FIG. 3 is a perspective view of a bundle of exchanger tubes of an exhaust gas heat exchanger according to a third exemplary embodiment.

FIG. 3 shows a perspective illustration of a bundle of exchanger tubes 20 of a heat exchanger 1 in a third implementation. As compared to the heat exchanger 1 shown in FIG. 1, the bundle of exchanger tubes 20 shown herein substantially differs by the fact that the exchanger tubes 20 are smooth, e.g., seamless drawn thin-walled stainless steel tubes that have no spiral-shaped structure 26 like the one shown in FIG. 1. Furthermore, the exchanger tubes 20 are arranged so as to intersect by pairs, this being visible at the inversion points of the U-shaped exchanger tubes 20 in FIG. 3.

In FIG. 1 it can be further seen how undesirable oscillations of the bundle of exchanger tubes 20 in the inner volume 42 of the housing 40 can be prevented by means of technical measures. The baffle plate 36, which is connected for mechanical rigid connection to the housing cover 60 and is disposed within the bundle of exchanger tubes 20, is connected at its side wall and at its bent tip to the neighbouring exchanger tubes 20 such as by soldering or welding for a mechanical solid connection. The baffle plate 36 thus mechanically stiffens the exchanger tubes 20 of the exchanger tube bundle lying inside, thus attenuating their oscillations.

As an additional measure to reduce the oscillations there is provided a bandage 30 made from a stamped stainless steel sheet of small wall thickness. This bandage completely surrounds the bundle of the exchanger tubes 20 and is connected at the contact points to the neighbouring exchanger tubes 20 for mechanical solid connection such as by means of welding or soldering. Thanks to the arrangement surrounding the bundle of exchanger tubes, the bandage 30 prevents relative oscillations of the outside lying exchanger tubes 20 relative to each other. Moreover, the bandage 30 forms integrally formed abutments 32 that consist of angled projections. These abutments 32 resiliently support the entire bundle of exchanger tubes with respect to the inner wall of the housing 40.

Finally, stiffening elements 34 are arranged within the bundle of exchanger tubes 20, which also are made from stamped stainless steel strips. These stiffening elements 34 constitute a mechanically rigid abutment of the exchanger tubes 20 of the bundle of exchanger tubes. For this purpose, they are connected to the exchanger tubes 20 for mechanical solid connection such as by means of welding or soldering.

It is noted that the mechanical solid connection of the bandage 30 or of the stiffening elements 34 to the discrete exchanger tubes 20 can be eliminated. Possibly, the mere interlock between the bundle of exchanger tubes and the bandage 30 or the stiffening element 34 may already provide for sufficient abutment of the bundle of exchanger tubes and for the bandage 30 or the stiffening elements 34 to sit sufficiently solidly on the bundle of exchanger tubes.

Figure 4:
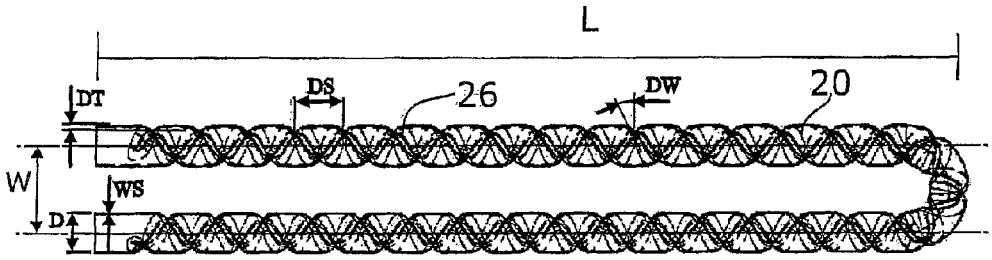
FIG. 4 is a schematic illustration of an exchanger tube of the heat exchanger shown in FIG. 1.

FIG. 4 now shows an elevation view of one exchanger tube 20 of the heat exchanger 1 according to the first exemplary embodiment. The exchanger tube 20 has a free length indicated at L that can range between two and 30 cm depending on the dimensions of the heat exchanger 1; if used in motor vehicles with an internal combustion engine of less output, appropriate typical dimensions of L are of about 5 cm. For private cars of higher output of 100 kW and more, dimensions of L ranging between 10 and 15 cm may be sensible. For use in trucks, dimensions of L=20 cm and more may be suited.

Figure 5:
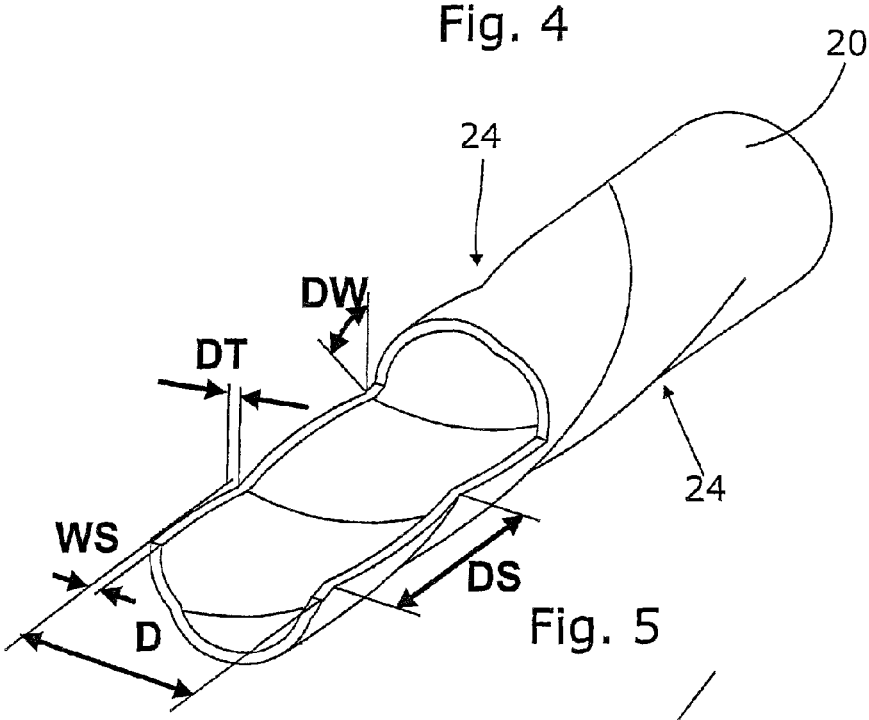
FIG. 5 is a sectional view through the exchanger tube shown in FIG. 4.

The exchanger tube 20 has an outer diameter D that typically ranges between 1 and 15 mm, preferably between 6 and 12 mm, since this diameter has been found particularly suited for using the heat exchanger in accordance with its purpose of utilization as an exhaust gas heat exchanger for a motor vehicle. As can be seen in FIG. 4 and in FIG. 5, which constitutes a perspective sectional view of the exchanger tube 20 of FIG. 4, values ranging from 0.1 to 1 mm are suited in case of a stainless steel compound, depending in particular also on the length L of the exchanger tube in the specific heat exchanger 1. Preferably, the wall thickness WS of the exchanger tubes 20 ranges from 0.2 through 0.6 mm.

For the spacing W between the legs of the U-shaped exchanger tubes 20, it has been found out that this spacing is preferably greater than or equal to twice the outer diameter D of the exchanger tube 20. The following applies in particular. W is greater than or equal to 2.2×D, wherein the leg width W is directly correlated to the bending radius R of the U-shaped exchanger tube 20 via W=2 R, if the exchanger tube 20 used is a thin-walled tube, for example made from stainless steel or aluminum, provided with a continuous spiral structure 26. A particularly small leg width W is of benefit for most efficient possible occupancy of the inner volume of the housing 40 and is to be preferred due to the very limited space available in a motor vehicle.

Within the frame of practical testing it has been found out that particularly advantageous properties with respect to generating a turbulence in the exhaust gas flowing through the exchanger tube 20 and as a result thereof a particularly intensive heat transfer from the exhaust gas to the wall of the exchanger tube are achieved if the exchanger tube comprises a spiral structure 26 at least on its inner wall. The spacing DS between the windings of the spiral structure 26 advantageously ranges between 1 and 15 mm, with a range of between 4 and 8 mm being preferred. The resulting pitch is indicated at DW in FIG. 4. The height DT of the raised spiral structure 26 on the inner wall of the exchanger tube 20 advantageously ranges between 1 and 20% of the outer diameter D of the respective exchanger tube 20, with a range of between 4 and 14% being preferred here.

If a plurality of exchanger tubes 20 is provided for a bundle of exchanger tubes to form, it has been found out that the efficiency achievable if the heat exchanger is used according to its purpose of utilization is particularly high if the minimum distance d between the outer surfaces of the respective exchanger tubes 20 of the bundle of exchanger tubes ranges between 0.5 and 5 mm. A range of between 1 and 2 mm is preferred here, since it yields particularly good results with respect to efficiency if water is used as the coolant.

In a particularly preferred implementation, the spiral structure 26 in the exchanger tube 20 is not only formed on the inner surface of the exchanger tube 20. Instead, the spiral structure 26 is produced by stamping a spiral shape into the outer surface of the exchanger tube 20, which results in a stamped raised spiral structure 26 on the inner surface of the exchanger tube 20.

Figure 6:
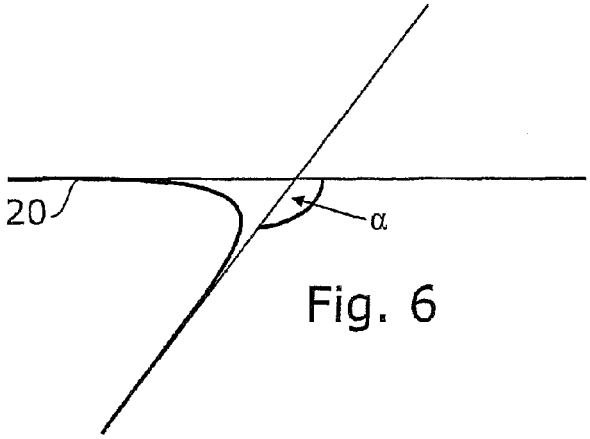

FIG. 6 schematically shows the angle of rotation alpha that is surrounded by the flow path forming in the exchanger tube 20. In the preferred embodiments of the heat exchanger 1 of the invention, this angle of rotation alpha is 180°, i.e., the flow direction of the exhaust gas flow exiting the inner volume 42 of the heat exchanger 1, is 180° opposite the flow direction of the entering exhaust gas flow. In other configurations, the angle of rotation a may however be smaller or greater than 180°, an angular range of between 135° and 225° being generally preferred. The use of exchanger tubes 20 forming a spiral structure 26 on their inner surface has already been found to increase efficiency at an angle of rotation a of 45°.

Figure 7:
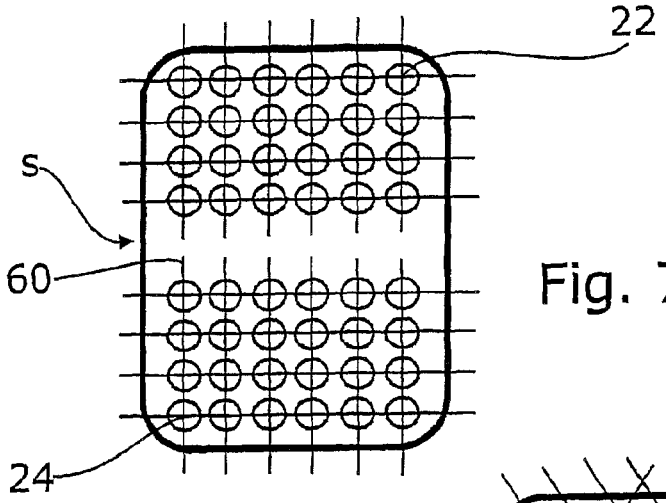
FIG. 7 is an elevational view of the interface S formed by a housing cover in which the inlet and the outlet openings are disposed on grid places of an orthogonal grid.

FIG. 7 schematically shows once more an elevation view of the inlets 22 and the outlets 24 of a plurality of exchanger tubes 20 that are arranged in a bundle in the inner volume 42 of a heat exchanger housing 40. It appears that both the inlets 22 and the outlets 24 are disposed on the grid points of an orthogonal grid.

Figure 8:
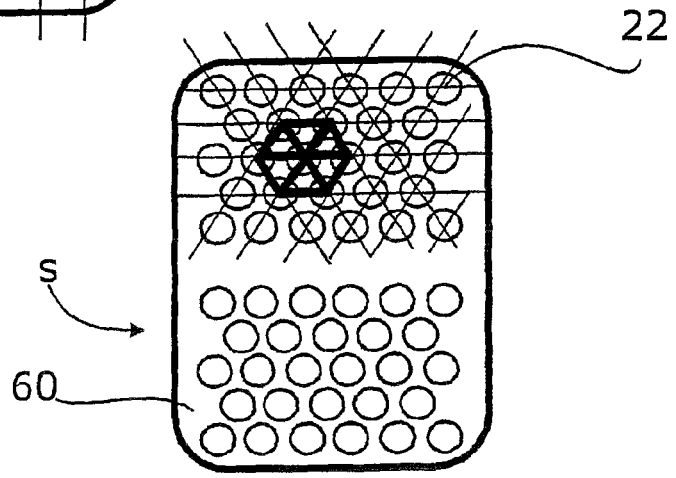
FIG. 8 is an elevational view of the interface S formed by a housing cover in which the inlet and the outlet openings are disposed on grid places of a hexagonal grid.

An even more efficient space occupancy is obtained if the inlets 22 and outlets 24 are arranged as shown in FIG. 8. Here, the inlets 22 or outlets 24 are disposed on grid points of a hexagonal grid, which means that each inlet 22 or each outlet 24 is surrounded by six neighbouring inlets 22 or outlets 24. In this configuration, the space inside the inner volume 42 of the housing 40 can be best used for the exchanger tubes 20.

Figure 9:
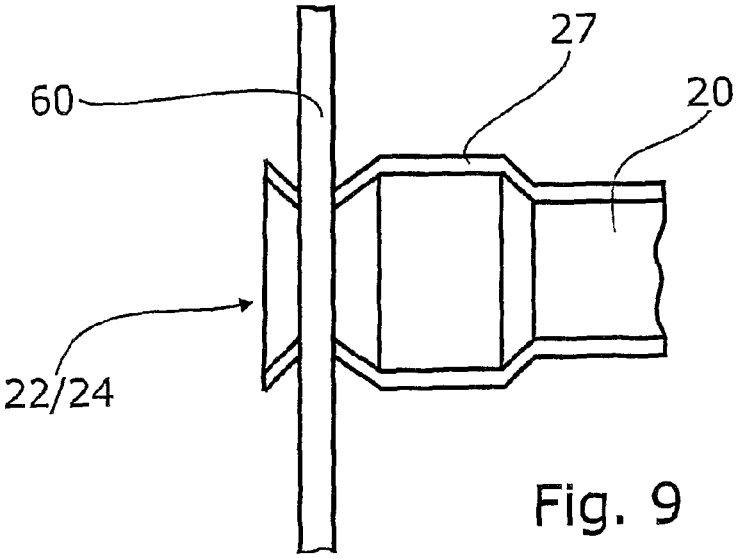
FIG. 9 is a sectional view through an inlet/outlet opening of an exchanger tube in the region of a housing cover.

FIG. 9 shows a sectional view of a housing cover 60 in the region of a hole through which the inlet or outlet side end 22/24 of an exchanger tube 20 is threaded. In a preferred implementation, which offers particular advantages for manufacturing, the exchanger tube 20 comprises at its inlet or outlet side end 22/24 a supporting structure 27 that forms a mechanical abutment of the tube end with respect to the housing cover 60. This supporting structure may for example be formed from one or several dot-shaped projections, in the exemplary embodiment shown in FIG. 4 it is stamped as a circumferential bulge. In the exemplary embodiment shown in FIG. 9, the outer end of the exchanger tube 20 is beaded so that, generally, the exchanger tube 20 mechanically abuts the housing cover 60 through the combination of supporting structure 27 and beaded end. This abutment is obtained by virtue of the structural properties of the tube end of the exchanger tube 20 and substantially facilitates the manufacturing of the heat exchanger of the invention since the exchanger tubes 20 are already pre-fixed mechanically in the housing cover 60. This dispenses with the need for additionally fixing the exchanger tubes 20 to the housing cover 60 such as by means of laser welding spots during subsequent soldering or welding of the exchanger tube ends to the housing cover 60. The structures shown in FIG. 9 may be made in the simplest way in the exchanger tube end by threading an exchanger tube 20 with uniform inner and outer diameter through the corresponding hole in the housing cover 60. After that, the circumferential bulge 27 and at the same time the beaded edge is produced using an appropriate tool. This appropriate tool is for example a tube expansion tool.

Figure 10:
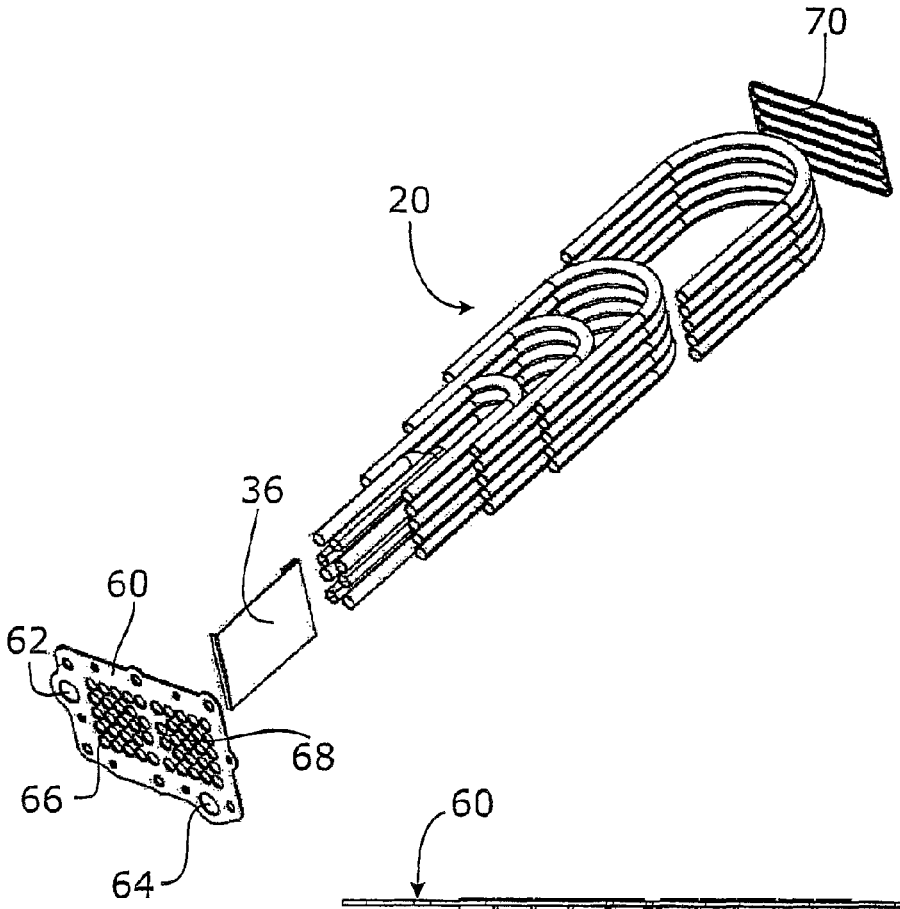
FIG. 10 is an exploded view of another embodiment of a vibration reduced bundle of exchanger tubes.
Figure 11:
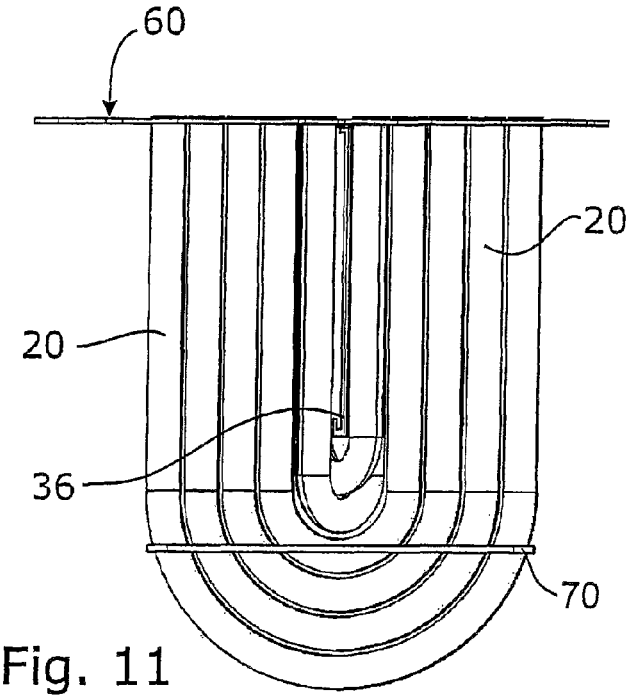
FIG. 11 is a top view of the vibration reduced bundle of exchanger tubes shown in FIG. 10.

FIG. 10 shows the bundle of exchanger tubes of another exhaust gas heat exchanger 1 of the invention, the structure of which substantially corresponds to the bundle of exchanger tubes shown in FIG. 3, various vibration reducing measures having been taken. For example, at the inside end, in the region of the U-shaped deflection of the exchanger tubes 20, a grid sheet 70 has been pushed over the exchanger tubes 20. From FIG. 11, which shows the bundle of exchanger tubes in its mounted condition, it can be seen that all the exchanger tubes 20, except for the two inner exchanger tubes 20, are taken hold of by the grid sheet 70 so that they are supported mechanically. During mounting of the heat exchanger 1 of the invention, the grid sheet 70 can be pushed onto the exchanger tubes 20. Moreover, it can also be mechanically fixed to a singular or plural number of exchanger tubes 20 on the bundle of exchanger tubes by means of further measures such as soldering. The grid sheet 70 is thereby made in the form of a part cut out of a metal sheet the thickness of which preferably ranges between 0.5 and 2 mm. Since in most cases it is not the highly corrosive exhaust gas but only the coolant that flows around it, it may for example be made from aluminum, but preferably from a corrosion resistant steel sheet.

As can be further seen from FIG. 10, a baffle 36 is inserted between the two legs of the innermost exchanger tubes 20 that intersect in the region of the U-shaped deflection, the baffle being mechanically solidly connected to the housing cover 60, such as by soldering or spot-welding. At the end opposite the housing cover 60, the baffle 36 comprises a U-shaped fold the opening width of which substantially corresponds to the opening width of the U-legs of the innermost lying U-shaped exchanger tubes 20 and is preferably of slightly larger dimensions. The fold has a certain spring effect so that the baffle 36 can be inserted between the legs of the exchanger tubes and that the innermost lying exchanger tubes 20 can mechanically abut the fold of the baffle 36. Beside this friction locking connection between the baffle 36 and the innermost lying exchanger tubes 20, a positive locking connection can also be additionally made, such as by soldering.

Figure 12:
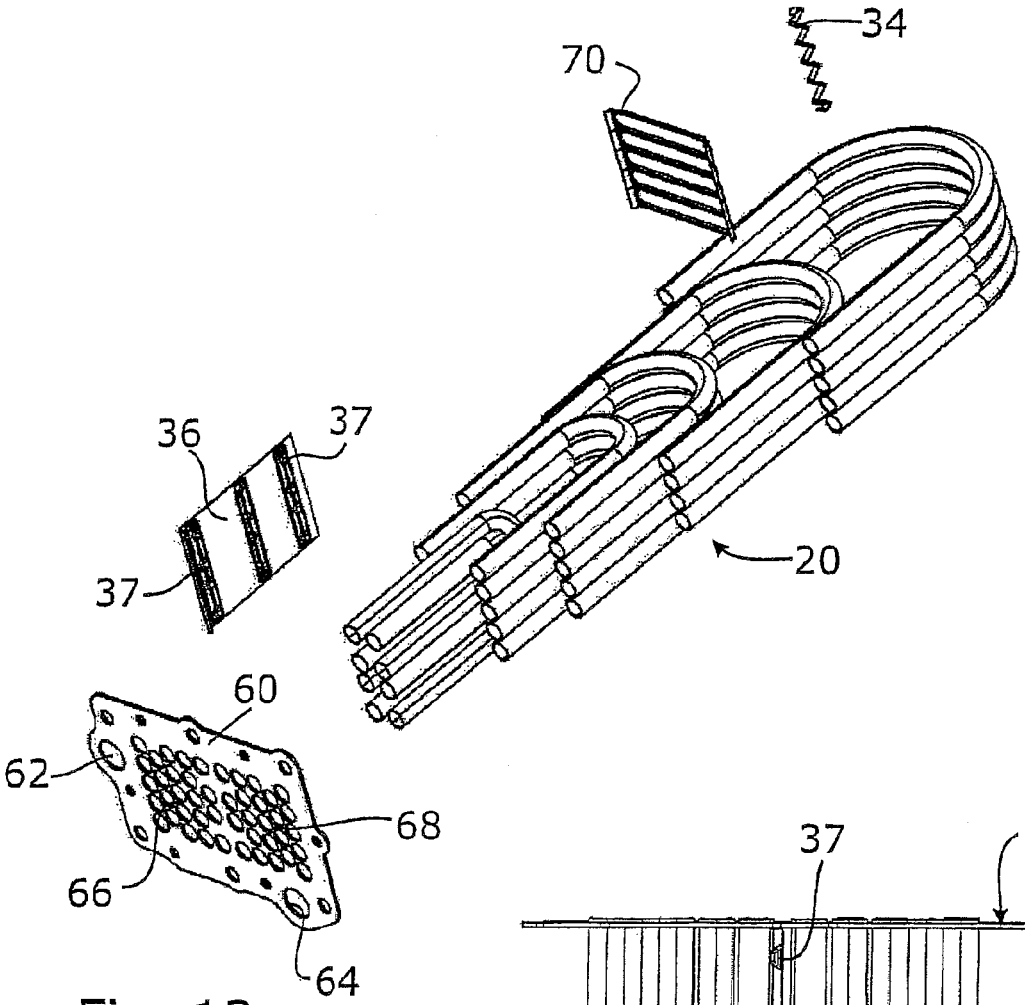
FIG. 12 is an exploded view of another embodiment of a vibration reduced bundle of exchanger tubes.

FIG. 12 now shows the bundle of exchanger tubes of another exhaust gas heat exchanger of the invention in an exploded view, this bundle of exchanger tubes substantially corresponding in its structure to the bundle of exchanger tubes shown in FIG. 10. For this reason, only the differences will be discussed. In this exemplary embodiment, the grid sheet 70 is made smaller so that it no longer overlaps the two outer layers of exchanger tubes, as this can be seen in FIG. 13. It can be further seen from FIG. 13 that the shape chosen for the grid sheet 70 is such that it follows the inner contour of the second outermost layer of exchanger tubes 20, this resulting in a clamping seat of the grid sheet 70.

In order to prevent vibrations of the two outer layers of exchanger tubes, a separate stiffening element 34 consisting of a many times angled sheet strip is inserted between these two layers of exchanger tubes in the region of the U-shaped deflection, said stiffening element being in the simplest case inserted between the two layers of exchanger tubes during mounting. In an improved implementation, the stiffening element is further mechanically connected to the two layers of exchanger tubes, such as by soldering.

Figure 13:
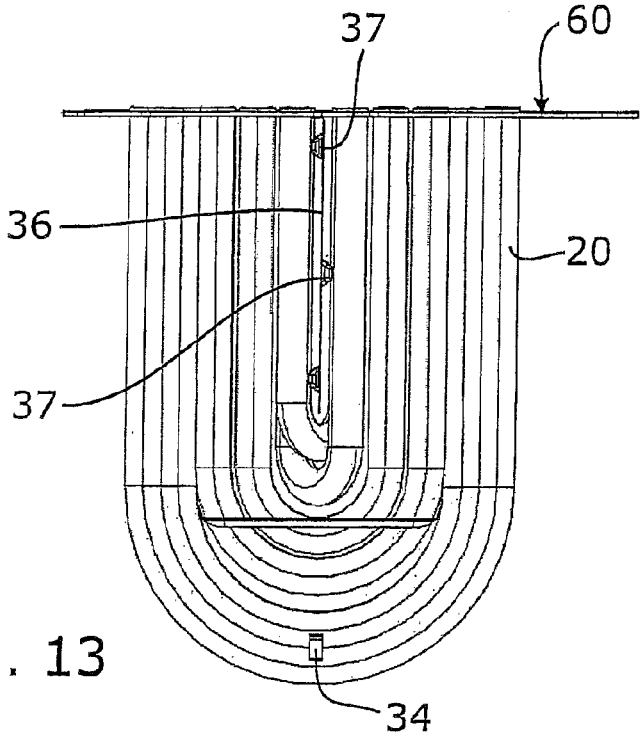
FIG. 13 is a top view of the vibration reduced bundle of exchanger tubes shown in FIG. 12.

Further, the baffle 36 has been changed with respect to the implementation shown in FIG. 10; this can be seen from the FIGS. 12 and 13. The baffle 36 forms three spacer elements 37 that have been formed for example by stamping the baffle 36 and that are raised structures on opposite surfaces of the baffle 36, as is obvious from FIG. 13. From FIG. 13 it can also be seen that the spacer elements 37 are dimensioned such that the baffle 36, when it is being inserted between the two innermost layers of exchanger tubes, is brought into abutment with the spacer elements 37 there. Here also, an additional positive locking connection can be provided between the spacer elements 37 of the baffle 36 and the innermost layers of exchanger tubes, such as by soldering.

Figure 14:
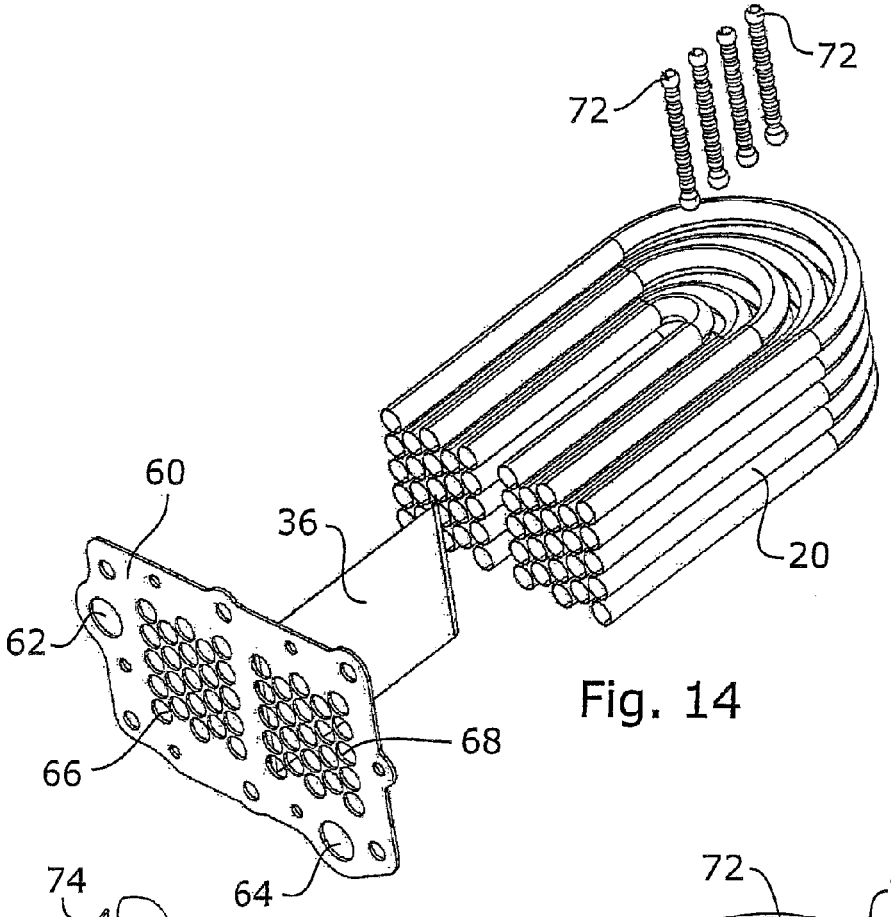
FIG. 14 is an exploded view of another embodiment of a vibration reduced bundle of exchanger tubes.

FIG. 14 shows the bundle of exchanger tubes of another exhaust gas heat exchanger 1 of the invention the structure of which again substantially corresponds to the one shown in FIG. 3. As compared to FIG. 3, the bundle of exchanger tubes shown in FIG. 14 differs on the one side through the baffle 36 inserted in the innermost layer of exchanger tubes; the innermost layer here does not consist of alternately intersecting exchanger tubes 20. Here, the innermost layer of exchanger tubes 20 mechanically abuts the baffle 36, which is mechanically solidly connected to the housing cover 60, through the inner end of the baffle 36, which is angled to form a portion of a circle. As a result, a resilient end of the baffle 36 is formed, which is brought into mechanical contact with the U-shaped deflection regions of the innermost layer of exchanger tubes.

Figure 15:
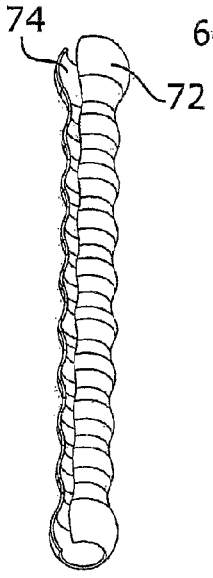
FIG. 15 is a perspective view of a vibration reducing spring element shown in FIG. 14.

Further, between the discrete layers of exchanger tubes in the U-shaped region of deflection, there is inserted a separate spring element 72 that can be seen in detail in FIG. 15. This spring element 72 is made from a resilient sheet of for example corrosion-resistant steel, a slot 74 being provided for achieving a spring effect. The shape of the spring element 72 strongly mates the layer structure of the exchanger tubes 20 so that in the bundle of exchanger tubes ready for use shown in FIG. 16 the spring elements 72 determine the spacing of the adjacent exchanger tubes 20 both in the horizontal and in the vertical direction. A simple positive locking connection can thus be obtained between the exchanger tubes 20 and the spring elements 72, but also the spring elements 72 can be joined by a positive locking connection to the adjacent layers of exchanger tubes 20, for example by soldering. By virtue of its geometrical structure, the spring element 72 has a spring action not only transverse to its longitudinal axis. It also has a certain spring action in the direction of its longitudinal axis. If the spring elements 72 are dimensioned accordingly, they can additionally contact with their outer heads the inner surface of the housing case 50 of the exhaust gas heat exchanger 1, thus providing for additional mechanical abutment of the entire bundle of exchanger tubes on the housing case 50.

Figure 16:
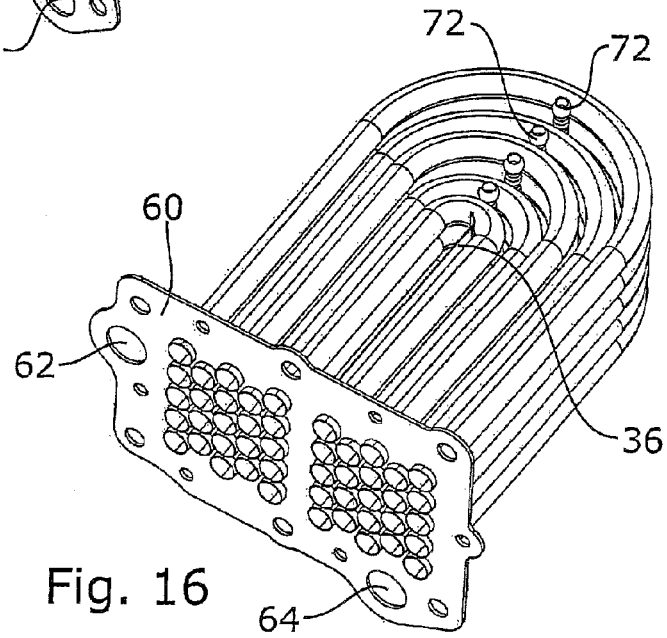
FIG. 16 is a perspective view the vibration reduced bundle of exchanger tubes shown in FIG. 14.
Figure 17:
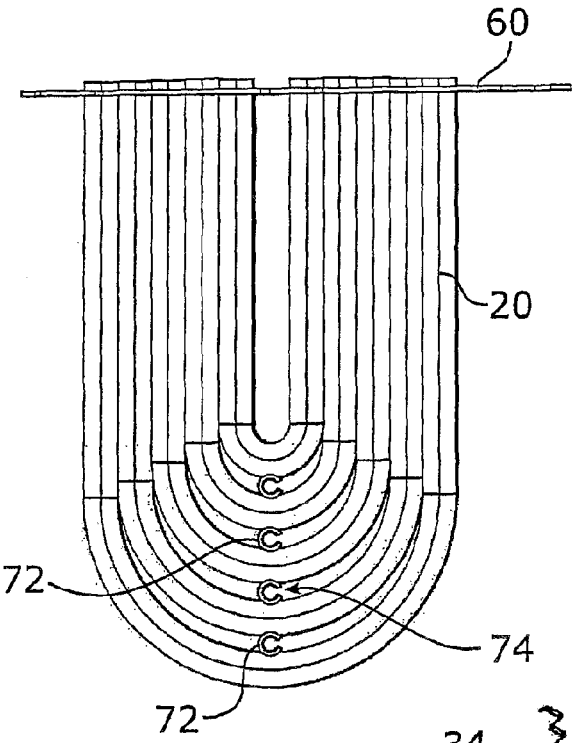
FIG. 17 is a top view of the vibration reduced bundle of exchanger tubes shown in FIG. 14.

FIG. 17 shows another top view of the bundle of exchanger tubes shown in FIG. 16, the regular arrangement of the slot 74 provided for in the spring element 72 being clearly visible in this illustration.

Figure 18:
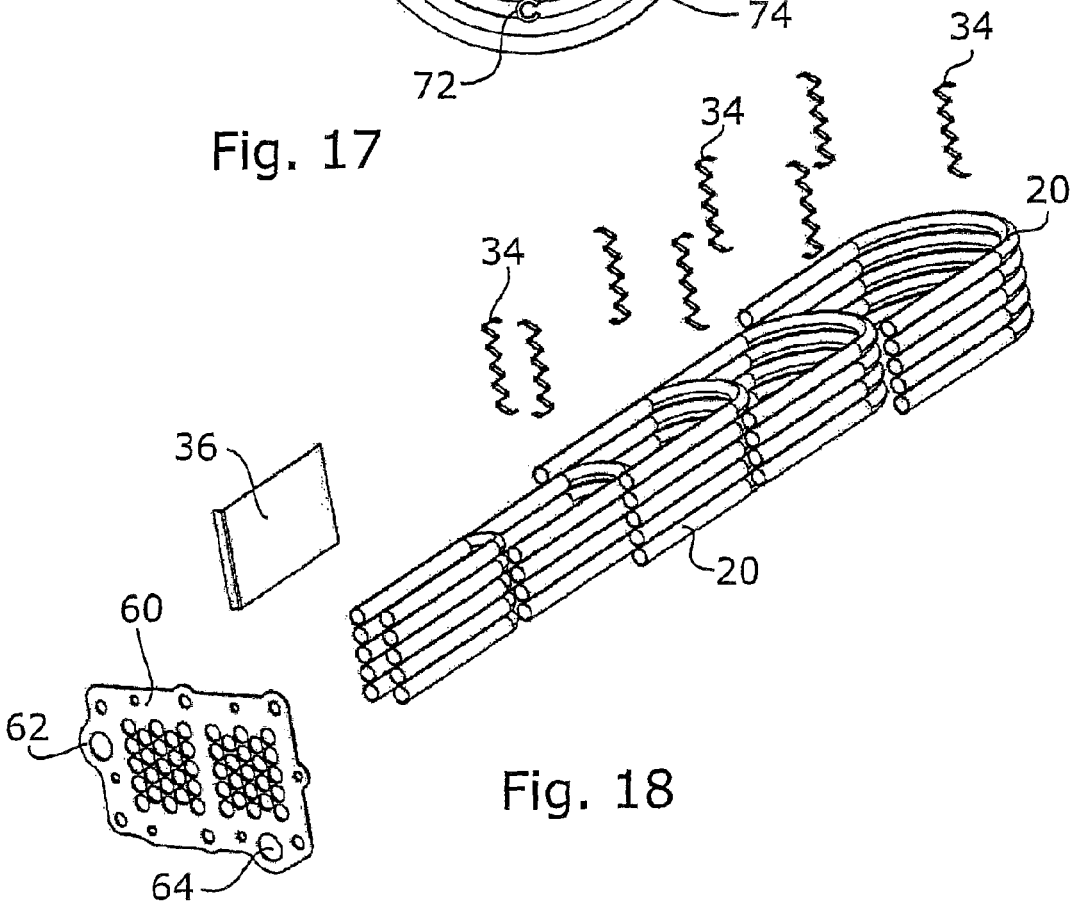
FIG. 18 is an exploded view of another embodiment of a vibration reduced bundle of exchanger tubes.

FIG. 18 shows the bundle of exchanger tubes of a last exemplary embodiment of an exhaust gas heat exchanger 1 of the invention, again in an exploded view. Here again, the structure of the bundle of exchanger tubes substantially corresponds to the one shown in FIG. 3 so that only the differences will be discussed. Like in the previous exemplary embodiments, a baffle 36 is inserted between the legs of the innermost layer of exchanger tubes, said baffle being connected by a positive locking connection to the housing cover 60 (not shown in FIG. 20 for reasons of clarity). Further, a plurality of stiffening elements 34 are inserted between the discrete layers of the exchanger tubes 20, said stiffening elements consisting of a many times angled strip of steel sheet and substantially following the arrangement of the exchanger tubes 20 in the inner volume 42 of the heat exchanger 1. Through the stiffening elements 34, adjacent exchanger tubes 20 abut each other both in the horizontal and in the vertical direction. The stiffening elements 34 can be fixed in their position by a positive locking connection with the exchanger tubes 20. They can further also be connected by a positive locking connection to the exchanger tubes 20, such as by soldering. Further, the stiffening elements 34 form at their two ends resilient tongues through which the stiffening elements 34 and the exchanger tubes 20 connected thereto mechanically abut the inner wall of the housing case 50 of the heat exchanger 1. From FIG. 19 it can be seen in which way the stiffening elements 34 can be inserted between the discrete layers of the exchanger tubes 20 during mounting of the heat exchanger 1 of the invention. By virtue of the shape of the stiffening elements 34, the stiffening elements 34 are retained on the exchanger tubes 20 thanks to the positive locking connection.

Figure 19:
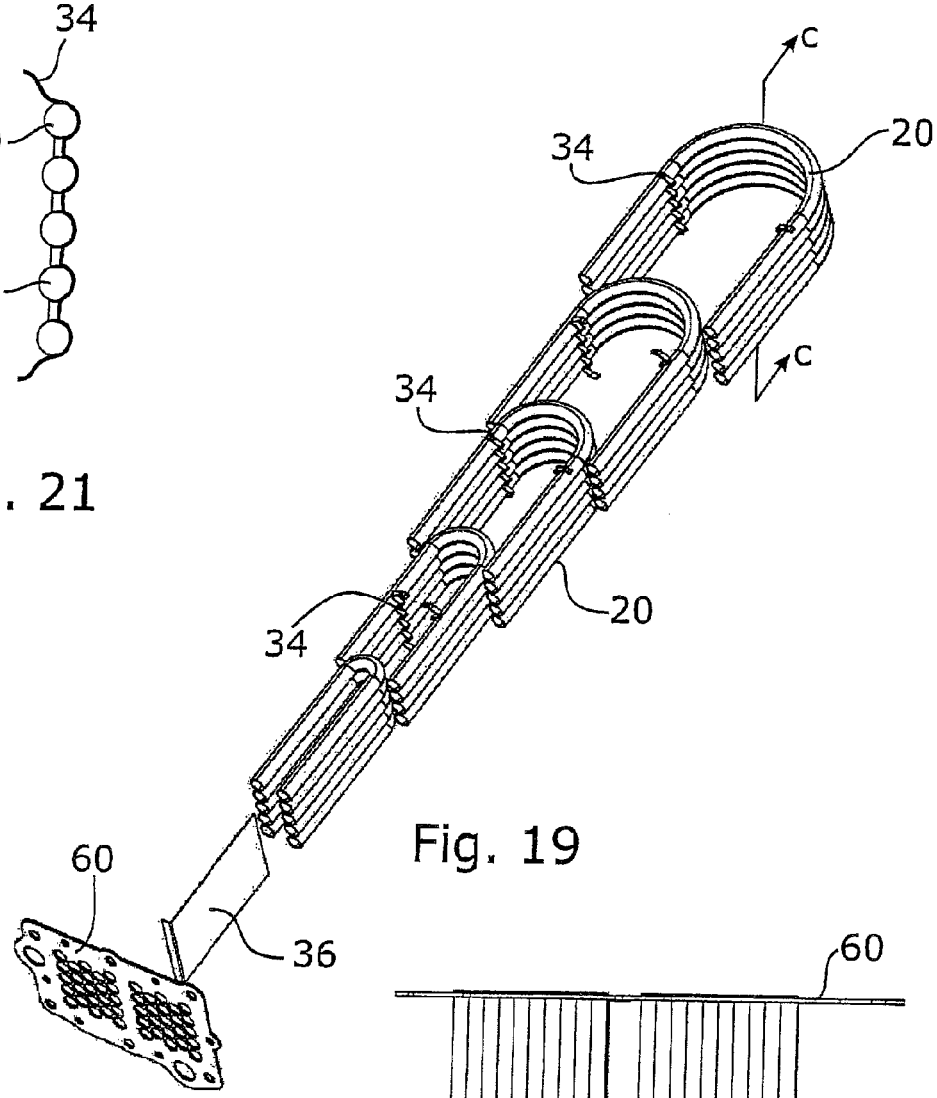
FIG. 19 is another exploded view of the bundle of a vibration reduced bundle of exchanger tubes shown in FIG. 18, showing the location of a plurality of stiffening elements.

As already mentioned, the mechanical connection can be further improved if the stiffening elements 34 are soldered to the exchanger tubes 20. For this purpose, the stiffening elements 34 can be coated on one or two sides with solder material. Once the entire arrangement shown in FIG. 19 is assembled, it can be conveyed through a solder furnace for soldering the stiffening elements 34 to the exchanger tubes 20. This kind of soldering is also particularly suited for use elsewhere, wherever a positive locking connection between discrete components of the exhaust gas heat exchanger has been previously mentioned.

Figure 20:
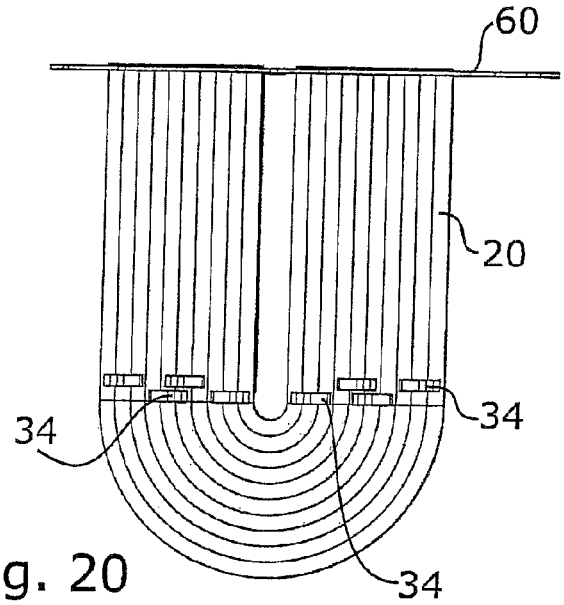
FIG. 20 is a top view of the vibration reduced bundle of exchanger tubes shown in FIG. 18.

FIG. 20 shows once more the bundle of exchanger tubes of FIG. 19 in the condition ready for operation, the arrangement of the stiffening elements 34 between the layers of exchanger tubes 20 being clearly visible here.

Figure 21:
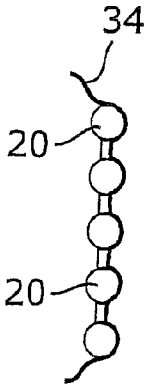
FIG. 21 is a sectional view through an outer bundle of exchanger tubes shown in FIG. 19, taken along line C-C.

FIG. 21 shows a section through the outermost layer of exchanger tubes in FIG. 19, along the line C-C. Here, another stiffening element 34 can be placed, for example soldered, onto the outer layer of exchanger tubes 50 in addition to the many times angled stiffening elements 34 shown in FIG. 19. As can be seen from FIG. 21, the shape of the stiffening element 34 substantially conforms to the arrangement of the exchanger tubes 20. In the improved exemplary embodiment shown in FIG. 21, the stiffening element 34 additionally forms spacer elements 37 interposed between the discrete exchanger tubes 20. In a further improved implementation, they can form additional spring elements 35 at their ends, said spring elements ensuring an advantageous clamping seat of the stiffening elements 34 on the exchanger tubes 20, in particular during mounting of the bundle of exchanger tubes of the heat exchanger 1 of the invention.

Figure 22A:
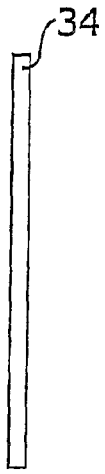
FIG. 22A is an elevational view of a first embodiment of the stiffening element shown in FIG. 21.
Figure 22B:
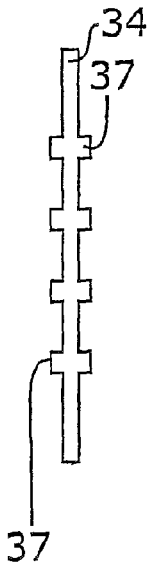
FIG. 22B is an elevational view of a second embodiment of the stiffening element shown in FIG. 21.
Figure 22C:
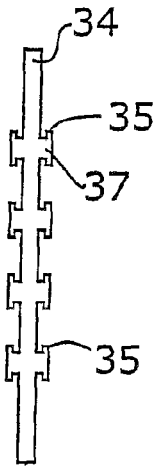
FIG. 22C is an elevational view of a third embodiment of the stiffening element shown in FIG. 21.

Finally, strips of steel sheet (stamped parts) can be seen from the FIGS. 22A, 22B, and 22C, which can be used to manufacture the stiffening elements 34 shown in FIG. 21. FIG. 22A shows a simple strip of steel sheet that is deformed so as to substantially correspond to the superimposed arrangement of the exchanger tubes 20. Additional spacer elements 37, as they can be seen from FIG. 21, are not provided here. By contrast, the stiffening elements 34 shown in the FIGS. 22B and 22C have such spacer elements 37, said spacer elements 37 being angled 90° during the manufacturing of the stiffening element 34. The stiffening element 34 shown in FIG. 22C finally has, in addition to the spacer elements 37, additional spring elements 35 that are disposed at its ends and that are once more angled 90° with respect to the plane of the spacer elements 37 during manufacturing of the stiffening elements 34. By virtue of the fact that they are arranged in the cooling water, the strips of steel sheet used for manufacturing the stiffening elements 34 can be formed from aluminum for example, preferably however from a resilient corrosion-resistant steel.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A heat exchanger for the exhaust gas system of a motor vehicle comprising:

a closed housing;

a bundle of separately formed exhaust gas carrying exchanger tubes disposed in the housing, wherein a coolant flows through the housing and around an outer surface of the exchanger tubes, wherein each of the exchanger tubes is substantially U-shaped and includes a first straight portion, a second straight portion, and a bend region connecting the first straight portion to the second straight portion;

a stiffening element abutting the bend region of each of a first plurality of the exchanger tubes to mechanically interconnect the first plurality of the exchanger tubes; and a baffle extending between the first straight portion and the second straight portion of each of the exchanger tubes, the baffle abutting at least one of the first straight portion and the second straight portion of each of a second plurality of the exchanger tubes to mechanically interconnect the second plurality of the exchanger tubes.

2. The heat exchanger according to claim 1, wherein the stiffening element is formed from a strip of material.

3. The heat exchanger according to claim 2, wherein the strip of material includes at least one contoured portion formed therein, wherein the at least one contoured portion substantially conforms to and receives at least a portion of the outer surface of the exchanger tubes.

4. The heat exchanger according to claim 3, wherein the stiffening element and the outer surface of the exchanger tube are soldered together.

5. The heat exchanger according to claim 3, wherein the strip of material further includes a first resilient tongue formed at a first end of the strip and a second resilient tongue formed at a second end of the strip, the first resilient tongue and second resilient tongue mechanically abutting an inner surface of the housing.

6. The heat exchanger according to claim 3, wherein the strip of material includes a plurality of contoured portions and the stiffening element further includes a plurality of spacer elements disposed between adjacent contoured portions of the strip of material.

7. The heat exchanger according to claim 6, wherein the spacer elements include an angled portion and a flat portion, the angled portion angled 90 degrees with respect to the flat portion.

8. The heat exchanger according to claim 7, wherein the spacer elements further include a resilient second spring element.

9. The heat exchanger according to claim 8, wherein the second spring element is angled 90 degrees with respect to the angled portion of the spacer elements.

10. The heat exchanger according to claim 9, wherein at least a portion of the outer surface of the exchanger tubes abut the second spring element.

11. The heat exchanger according to claim 2, wherein the strip of material includes at least one first portion bent in a first direction and at least one second portion bent in a second direction, wherein the at least one first portion and the at least one second portion are successively arranged to form a substantially linear saw-tooth configuration having at least one substantially V-shaped opening to one side of the stiffening element for receiving at least a portion of one of the exchanger tubes and at least one substantially V-shaped opening to an opposite side of the stiffening element for receiving at least a portion of another one of the exchanger tubes.

12. The heat exchanger according to claim 11, wherein the strip of material further includes a first resilient tongue formed at a first end of the strip and a second resilient tongue formed at a second end of the strip, the first resilient tongue and second resilient tongue mechanically abutting an inner surface of the housing.

13. The heat exchanger according to claim 11, wherein the stiffening element and the outer surface of the exchanger tube are soldered together.

14. The heat exchanger according to claim 2, wherein the strip of material is formed from one of a resilient corrosion-resistant steel and aluminium.

15. The heat exchanger according to claim 1, wherein the baffle includes a first spacer element protruding from a first side of the baffle and a second spacer element protruding from a second side of the baffle opposite the first side.

16. The heat exchanger according to claim 15, wherein the first spacer element abuts the first straight portion of each of the second plurality of the exchanger tubes and the second spacer abuts the second straight portion of each of the second plurality of the exchanger tubes.

17. The heat exchanger according to claim 16, wherein the baffle is oriented on a first plane and the second plurality of the heat exchanger tubes includes a first exchanger tube oriented on a second plane inclined with respect to the first plane and a second exchanger tube oriented on a third plane inclined with respect to the first plane, the second plane and the third plane transversely arranged.

18. A heat exchanger for the exhaust gas system of a motor vehicle comprising:

a closed housing;

a bundle of separately formed exhaust gas carrying exchanger tubes disposed in the housing, wherein a coolant flows through the housing and around an outer surface of the exchanger tubes, wherein each of the exchanger tubes is substantially U-shaped and includes a first straight portion, a second straight portion, and a bend region connecting the first straight portion to the second straight portion; and a stiffening element abutting the bend region of each of a first plurality of the exchanger tubes to mechanically interconnect the first plurality of the exchanger tubes; and a grid sheet including a plurality of linearly extending slots, each of the linearly extending slots receiving the bend region of each of a second plurality of the exchanger tubes to mechanically interconnect the second plurality of the exchanger tubes.

19. A heat exchanger for the exhaust gas system of a motor vehicle comprising:

a closed housing;

a bundle of separately formed exhaust gas carrying exchanger tubes disposed in the housing, wherein a coolant flows through the housing and around an outer surface of the exchanger tubes, wherein each of the exchanger tubes is substantially U-shaped and includes a first straight portion, a second straight portion, and a bend region connecting the first straight portion to the second straight portion; and a stiffening element abutting the bend region of a first plurality of the exchanger tubes to mechanically interconnect the first plurality of the exchanger tubes;

a grid sheet including a plurality of linearly extending slots, each of the linearly extending slots receiving the bend region of each of a second plurality of the exchanger tubes to mechanically interconnect the second plurality of the exchanger tubes; and a baffle extending between the first straight portion and the second straight portion of each of the exchanger tubes, the baffle abutting at least one of the first straight portion and the second straight portion of a third plurality of the exchanger tubes to mechanically interconnect the third plurality of the exchanger tubes.

* * * * *